US007400125B2

(12) United States Patent
Kojima et al.

(10) Patent No.: US 7,400,125 B2
(45) Date of Patent: Jul. 15, 2008

(54) POWER SUPPLY CIRCUIT WITH SERIES REGULATOR

(75) Inventors: Akio Kojima, Aichi-ken (JP); Junichi Nagata, Okazaki (JP)

(73) Assignee: Denso Corporation, Kariya (JP)

( * ) Notice: Subject to any disclaimer, the term of this patent is extended or adjusted under 35 U.S.C. 154(b) by 141 days.

(21) Appl. No.: 11/328,418

(22) Filed: Jan. 10, 2006

(65) Prior Publication Data

US 2006/0158164 A1 Jul. 20, 2006

Related U.S. Application Data

(63) Continuation-in-part of application No. 10/602,605, filed on Jun. 25, 2003, now abandoned.

(30) Foreign Application Priority Data

Jun. 26, 2002 (JP) ..... 2002-186016

(51) Int. Cl.
*G05F 1/40* (2006.01)
*G05F 1/56* (2006.01)

(52) U.S. Cl. ..... 323/282; 323/271; 323/284; 323/285

(58) Field of Classification Search ..... 323/268, 323/270, 271, 273–279, 282, 284, 285, 288, 323/289; 361/18, 86, 91.1, 91.2
See application file for complete search history.

(56) References Cited

U.S. PATENT DOCUMENTS 5,302,889 A 4/1994 Marsh
5,596,465 A 1/1997 Honda et al.
5,892,353 A * 4/1999 Yama ..... 323/282
5,932,996 A 8/1999 Liepe et al.
6,812,682 B2 11/2004 Hachiya
6,850,047 B2 2/2005 Itabashi et al.
6,984,966 B2 * 1/2006 Kubota et al. ..... 323/282
7,002,324 B2 * 2/2006 Uematsu et al. ..... 323/272
2006/0255785 A1 * 11/2006 Kanzaki ..... 323/282

FOREIGN PATENT DOCUMENTS

JP A-UM-H02-099413 8/1990
JP A-2000-155619 6/2000
JP 2001-209441 8/2001

OTHER PUBLICATIONS

Notification of Reasons for Rejection from Japanese Patent Office issued on Mar. 22, 2006 for the corresponding Japanese patent application No. 2002-186016.

* cited by examiner

*Primary Examiner*—Matthew V Nguyen
(74) *Attorney, Agent, or Firm*—Posz Law Group, PLC

(57) ABSTRACT

A series-regulator type of power supply circuit is provided. In the circuit, the emitter and collector of a transistor are connected to power input/output terminals. A control circuit controls a base current of the transistor based on the output voltage detected at the power output terminal and a given target voltage. A resistor circuit connects the base and the collector of the transistor. A bypass circuit connects the emitter and the base of the transistor and passes a bypass current. The accepting circuit connected to the power output terminal accepts (absorbs) current from an output current. An amount of the acceptance current is equal to or larger than an amount of the bypass current and a product of the bypass current and a resistance value of the resistance circuit is equal to or more than a difference between a voltage at the power input terminal and the target voltage.

20 Claims, 5 Drawing Sheets

POWER SUPPLY CIRCUIT WITH SERIES REGULATOR

CROSS REFERENCES TO RELATED DOCUMENT

The present application is a continuation-in-part application of Ser. No. 10/602,605 filed on Jun. 25, 2003 now abandoned and the entire disclosure of Japanese Patent Application No. 2002-186016 filed on Jun. 26, 2002 including the specification, claims, drawings and summary is incorporated herein by reference in its entirety.

BACKGROUND OF THE INVENTION

1. The Field of the Invention

The present invention relates to a power supply circuit with a series regulator.

2. Related Art

Power supply circuits, which are required by almost all electronic apparatuses, can be categorized into a large number of types, one of which is a series-regulator type of power supply circuit.

FIG. 1 exemplifies the electronic configuration of a series-regulator type of power supply circuit, which has typically been used by in-vehicle electronic equipment, such as ECU (Electronic Control Unit).

The power supply circuit 1 shown in FIG. 1 has a supply circuit 4 (main power supply) to which a voltage VS is supplied from a battery 2 via an ignition (IG) switch 3 and a second supply circuit 5 (auxiliary power supply) to which the voltage VB is supplied directly from the battery 2. Outputs of both supply circuits 4 and 5 are connected to a common output terminal 6 connected to a load circuit 7. The input side of the supply circuit 4 is connected to a second load circuit 8. The supply circuits 4 and 5 include main transistors 9 and 10, respectively. The emitter and a base of each main transistor 9 (10) are connected to its input and output. These two-systemized supply circuits 4 and 5 individually compose series regulators that operate on mutually-different target output voltages.

This series-regulator type of power supply circuit 1 operates as follows. When the ignition switch 3 is in the on-state, the supply circuits 4 and 5 both work, so that the voltage Vo at the output terminal 6 is stabilized to either one, which is higher than the other, of the target output voltage of the supply circuit 4 or that of the supply circuit 5. Meanwhile, when the ignition switch 3 is in the off-state, the supply circuit 5 operates alone, so that the voltage Vo at the output terminal 6 is stabilized to the target output voltage of the supply circuit 4.

In the latter case, the base and collector of the PNP-type transistor 9 are inserted into the circuit in the forward direction. Therefore, though it depends on how the load circuit 8 is configured, it may happen that current flows in the backward direction from the supply circuit 5 to the load circuit 8 via the collector and base of the transistor 9 and the resistor 11.

In order to avoid such a backward direction current, a conceivable countermeasure is to place a diode between the ignition switch 3 and the transistor 9. However, placing the diode there gives rise to a decrease in the input voltage to the supply circuit 4 correspond to the forward voltage Vf of the diode, thus providing a swell in a minimum operating voltage to the battery voltage VB.

The problem of this flow of backward current is not always inherent to the configuration where the two-systemized supply circuits 4 and 5 use a common output terminal. Such a problem may arise even in one-system power supply circuits, as long as there is a possibility that the power supply circuit is subjected to an inverse application of voltage from the load circuit 7.

SUMMARY OF THE INVENTION

An object of the present invention is to provide, with due consideration to the drawbacks of the above conventional configuration, a series-regulator type of power supply circuit capable of preventing current flowing from an output terminal to an input terminal in the power supply circuit.

In order to accomplish the above object, the present invention provides a power supply circuit comprising: a transistor of which emitter and collector are connected to a power input terminal and a power output terminal, respectively; a voltage detection circuit configured to detect an output voltage at the power output terminal; a voltage control circuit connected to a base of the transistor and configured to control a base current of the transistor on the basis of both of the output voltage detected by the voltage detection circuit and a given target voltage; a resistor circuit placed to connect the base and the collector of the transistor; a current bypass circuit placed to connect the emitter and the base of the transistor and configured to bypass the transistor so that a bypass current flows through the current bypass circuit; and a current accepting circuit connected to the power output terminal and configured to accept a given amount of current from an output current passing the power output terminal by performing either absorption or discharge of the given amount of current, wherein the amount of current to be accepted is equal to or larger than an amount of the bypass current and a product of the amount of the bypass current and a resistance value of the resistance circuit is equal to or more than a difference between a voltage at the power input terminal and the target voltage.

That is, in this power supply circuit, the resistor circuit is inserted between the base and the collector (not between the emitter and the base) of the transistor arranged between the power input/output terminals. This resistor circuit is able to fix a potential at the base to an amount equal to a potential at the collector, thereby strengthening resistance to noise.

In addition, in the case of the circuitry of this power supply circuit, the emitter/base of the transistor provides a backward conjunction against the voltage applied to the power output terminal. And this circuitry provides no current path bypassing the emitter/base of the transistor. Accordingly, a backward current through the emitter/base of the transistor can be prevented, owing to the fact that the junction between the emitter/base of the transistor has a characteristic of cutting off the backward current.

Meanwhile, an input voltage is applied to the power input terminal, a base potential of the transistor rises up to a value near to the input voltage in reply to an emitter potential, so that the resistor circuit undergoes application of a voltage nearly equal to a difference between the input and output voltages. This voltage applied to the resistor circuit causes a current flowing therethrough. This current, however, flows as a bypass current supplied by the current bypass circuit placed between the emitter/base of the transistor, not supplied as a base current. Since a product of the bypass current and a resistance of the resistor circuit is equal to or more than a difference of "the input voltage−the target voltage," all the current passing the resistor circuit in the condition where the output voltage is controlled to the target voltage can be supplied from the current bypass circuit. It is therefore possible to suppress the base current occurring due to the fact that the resistor circuit is added to the emitter/base of the transistor, thus preventing an unwanted swell in the output voltage on account of an excessive flow of the base current.

In cases where a load current decreases while the input voltage is applied to the power input terminal, it is difficult, if there is no current acceptance circuit configured according to the present invention, to give the resistor circuit the current necessary for suppressing the unwanted swell in the output voltage, which may bring about a situation where a voltage drop across the resistor circuit is reduced, resulting in an increase in the output voltage.

However, in the present embodiment, the current acceptance circuit is provided to avoid such an inconvenient situation. The current acceptance circuit has a capability of accepting current, the capability being equal to or higher than an amount of the bypass current. The current acceptance circuit thus absorbs or discharges the current that passes the resistance circuit. It is thus possible to make the current flow the resistance circuit even when there is no load, the current being required to suppress an unwanted swell in the output voltage. The output voltage can be controlled to the target voltage regardless of fluctuations in the amount of the load.

It is preferred that the current acceptance circuit is composed of a constant-current circuit. This makes it possible that, even when the output voltage fluctuates, the current acceptance circuit is able to steadily accept (practically, absorb or discharge) the current passing the resistor circuit from the current bypass circuit. The output voltage can be prevented from increasing beyond control.

It is still preferred that the current acceptance circuit is composed of a resistor. When giving the resistor an appropriately selected resistance value that is able to provide an amount of current equal to or higher than the bypass current, to an amount of the bypass current that flows under a condition where the output voltage is controlled to the target voltage, the output voltage can steadily be prevented from increasing beyond the target voltage.

Preferably, the current acceptance circuit is configured to absorb or discharge the acceptance current only when the current bypass circuit allows the bypass current to flow therethrough. Hence, in cases where the input voltage is not applied to the power input terminal so that the current bypass circuit is noting to do with the output of a bypass current, the current acceptance circuit is able to stop its current acceptance operation. An unnecessary output current will not therefore be stopped, thus saving a consumed power in the power supply circuit, thus increasing efficiency in energy saving.

Still, by way of example, it is preferred that the current bypass circuit is composed of a constant-current circuit. When the constant-current circuit is used, it is possible to provide a constant current that permits a product of the input voltage (which may fluctuate) and a resistance value of the resistor circuit to become an amount equal to or higher than a maximum difference between the input and output voltages. This prevents the output voltage from increasing over the target voltage in a reliable manner.

It is also preferred to, in addition to the main supply circuit, to comprise an auxiliary supply circuit configured to control the voltage at the power output terminal, independently of the voltage control performed by the main supply circuit. In this case, if the operation of the main supply circuit is stopped while one or more auxiliary supply circuits are in operation, a backward current circulating from the main supply circuit to the auxiliary supply circuits is eliminated. Without additional use of a backward-current preventing circuit such as a diode, there can be provided a plurality of supply circuit systems connected together to a common power output terminal.

DETAILED DESCRIPTION OF THE PREFERRED EMBODIMENTS

Referring to FIGS. 2 to 3A and 3B, an embodiment of the present invention will now be described.

Figure 2:
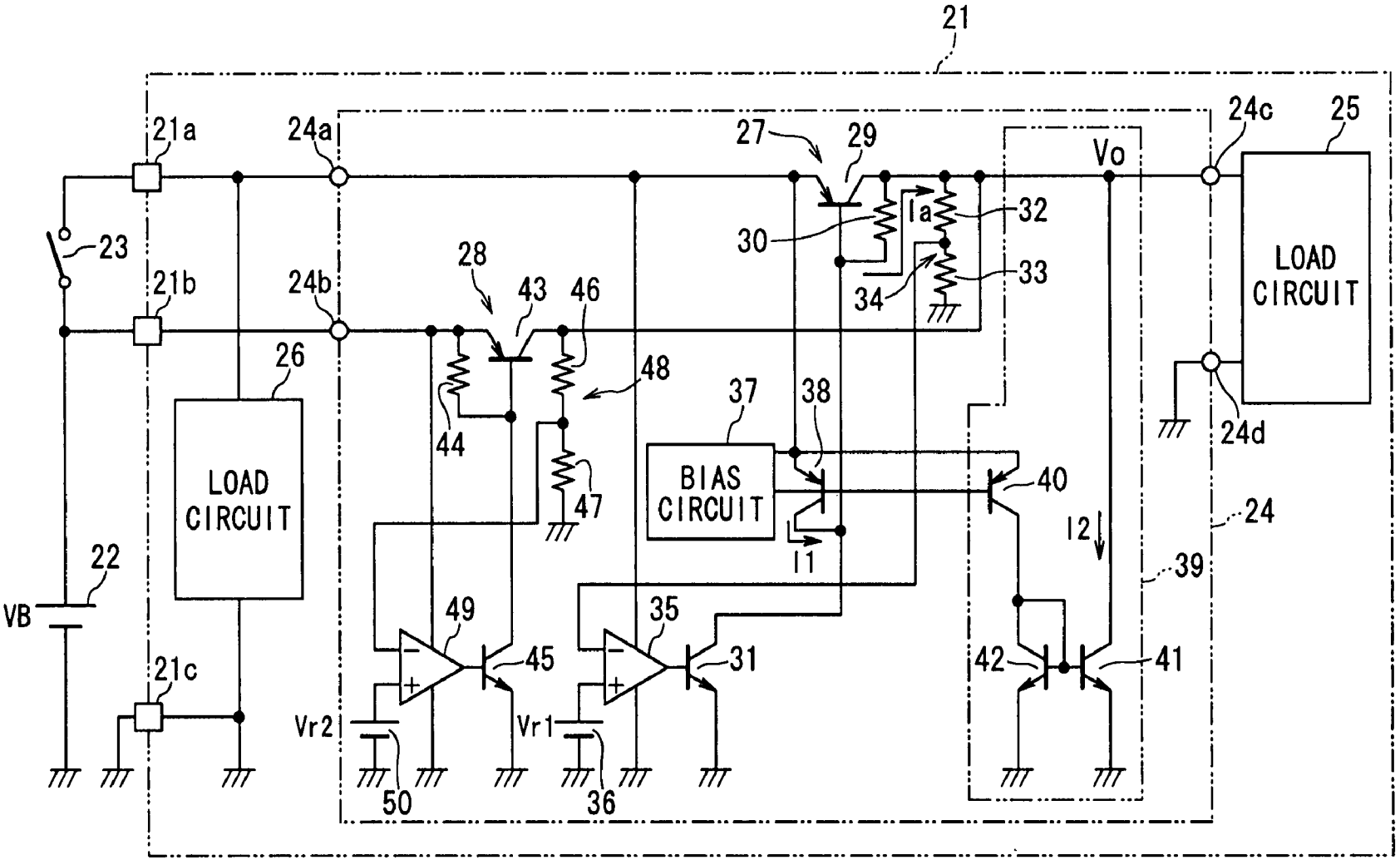
FIG. 2 shows the electrical configuration of a power supply circuit, which is applied to an in-vehicle ECU, according to an embodiment of the present invention.

FIG. 2 shows in detail a power supply circuit, which is particularly taken from the electrical configuration of an ECU (Electrical Control Unit) 21 for use in vehicles (cars).

The ECU 21 has terminals 21*a* to 21*c*, as shown therein. One of the terminals, 21*a*, is electrically connected to a positive terminal of a battery 22 via an ignition (IG) switch 23, while the other terminals 21*b* and 21*c* are electrically connected with the positive terminal and a negative terminal of the battery 22, respectively.

The ECU 21 includes a frame (not shown), which incorporates a substrate (not shown). On the substrate, a power supply circuit 24 constructed in the form of an IC, a load circuit 25 that operates on power voltage supplied from the power supply circuit 24, and a second load circuit 26 electrically connected with both the terminals 21*a* and 21*c* are provided.

Of these components, the load circuit 25, which is configured in the form of an IC different from the power supply circuit 24, includes a microcomputer serving as a main device therein. This microcomputer is formed to have both a normal operation mode and a low-power-consumption operation mode, and can selectively be switched one from the other. When the load circuit 25 is in low-power-consumption operation mode, consumed current is much lower to a large extent than that in the normal operation mode.

Meanwhile, the load circuit 26 includes a series circuit consisting of a switching element and a solenoid or relay coil, the switching element being subject to on/off control under a microcomputer.

The power supply circuit 24, which has terminals 24*a* to 24*c* formed as IC terminals, is provided with a supply circuit 27 (serving as a main power supply) intervening between the terminals 24*a* and 24*c* and a second supply circuit 28 (serving as an auxiliary power supply) intervening between the terminals 24*b* and 24*c*. The IC input terminals 24*a* and 24*b* are coupled with the terminals 21*a* and 21*b* of the ECU 21, respectively, while the output terminal 24*c* and the ground terminal 24*d* are coupled with power input terminals of the load circuit 25, respectively.

The supply circuits 27 and 28 are configured to have target output voltages of 5.0 [V] and 4.9 [V], respectively, and individually operate as a series regulator for controlling an output voltage Vo at the terminal 24*c* in a constant voltage control manner. One of the supply circuits, 27, has a configuration described below.

Both the terminals 24*a* and 24*c* are connected to an emitter and a collector of a PNP-type transistor 29 functioning as a main transistor. The base and the collector of the transistor 29 are connected to both terminals of a resistor 30 (composing a resistor circuit), while the base of the transistor 29 is electrically connected to the ground via the collector and emitter of a driving NPN-type transistor 31.

Further, the terminal 24*c* and the ground are connected to both terminals of a voltage dividing circuit 34 consisting of serially connected resistors 32 and 33 (composing a voltage detecting circuit). A resistor-connected point at which the voltage is divided is electrically connected to an inverting input terminal of the operational amplifier 35 that operates on the power from the terminal 24*a*. The output terminal of this operational amplifier 35 is connected to the base of the foregoing driving transistor 31, while a non-inverting input terminal of the operational amplifier 35 is connected to a reference voltage generating circuit 36 to output a reference voltage Vr1 corresponding to a target output voltage (5.0 [V]). In this configuration, the transistor 31 and operational amplifier 35 compose a voltage control circuit.

Still further, the emitter and the base of the transistor 29 are connected to a transistor 38 (composing a current bypass circuit), and the terminal 24*c* and the ground are connected to a constant-current circuit 39 (composing a current accepting circuit). Each of the transistor 38 and the constant-current circuit 39 is driven by a bias voltage produced by a bias circuit 37. The transistor 38, a transistor 40 constructing the constant-current circuit 39, and a transistor (not shown) constructing the bias circuit 37 have circuitry, in which all the bases thereof are connected together to a common base and all the emitters thereof are connected together to a common emitter. The constant-current circuit 39 is provided with a transistor 41 electrically inserted between the terminal 24*c* and the ground a further transistor 42 electrically inserted between the transistor 40 and the ground, both the transistors 41 and 42 composing a current mirror circuit.

This current mirror circuit configuration can be applied to both the transistors 38 and 40. As a result, a current ratio between the current bypass circuit and the current accepting circuit can be fixed, thus making it possible to steadily set the current to be accepted to an amount equal to or more than the bypass current.

It is particularly preferred that, if both the transistors 41 and 4Z are arranged close to each other to achieve the shortest wiring lengths therebetween so that a shift in the mirror ratio can be reduced. This arrangement for the shortest wiring length technique can also be applied to both the transistors 38 and 40, which can reduce a shift in the mirror ratio as well.

In contrast, the remaining supply circuit 28 is configured in a similar way to the conventional. To be specific, a PNP-type transistor 43 is placed so that its emitter and collector are electrically connected to the terminals 24*b* and 24*c*, while a resistor 44 intervenes between the emitter and the base of the transistor 43. The base of the transistor 43 is grounded through the collector and emitter of a driving transistor 45.

Furthermore, between the terminal 24*c* and the ground, there is connected a voltage-dividing circuit 48 consisting of serially connected resistors 46 and 47. An intermediate point between the resistors 46 and 47, at which the voltage is divided, is electrically connected to an inverting input terminal of an operational amplifier 49. This operational amplifier 49, which is driven on power supplied through the terminal 24*b*, has an output terminal electrically connected to the base of the driving transistor 45 and a non-inverting input terminal electrically connected to a reference voltage generating circuit 50 outputting a reference voltage Vr2 that corresponds to a further target output voltage (i.e., 4.9 [V]). Incidentally, each of the reference voltage generating circuits 36 and 50 is made with the use of, for example, a band-gap reference voltage circuit.

Figure 3A:
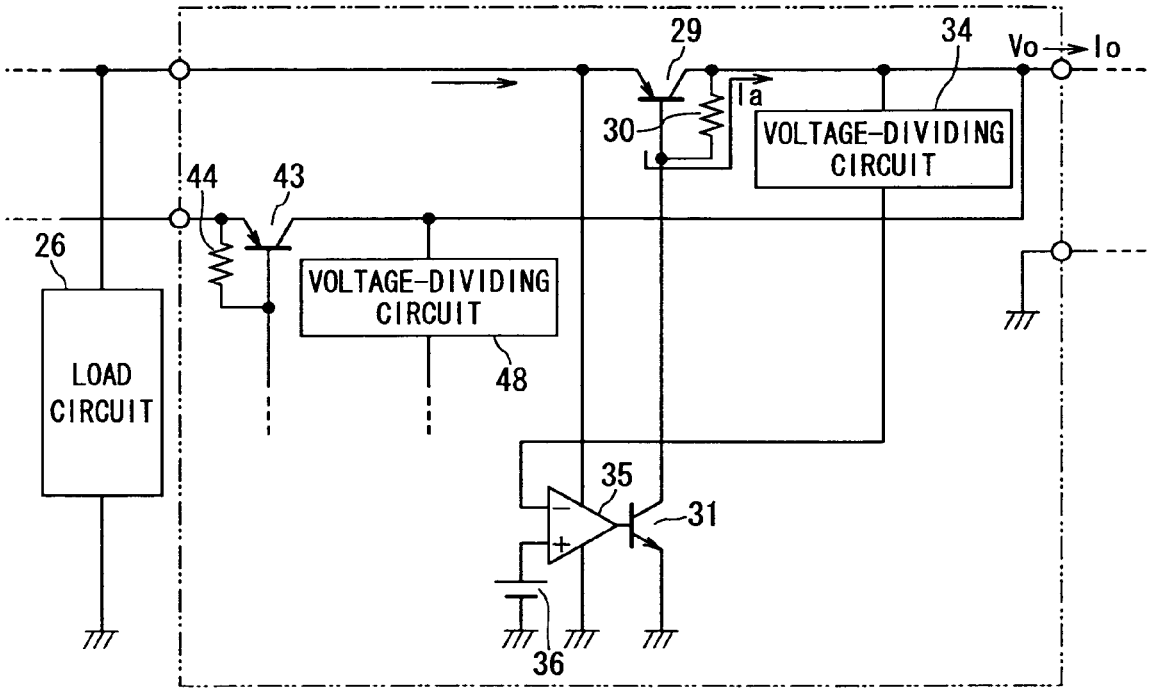
FIGS. 3A and 3B each show the electrical configurations of essential parts of the power supply circuits that were studied for achieving the power supply circuit according to the present invention.
Figure 3B:
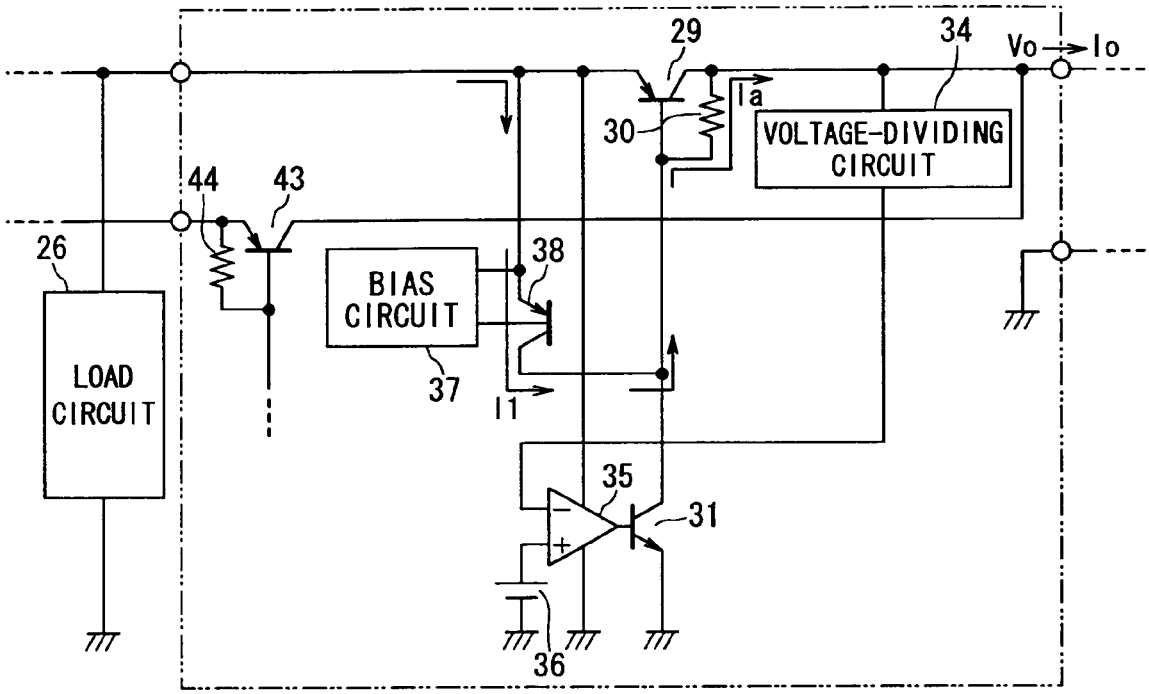

Referring to FIGS. 2, 3A and 3B, the ECU 21 including the power supply circuit 24 will now be explained in terms of its operation.

When the ignition switch 23 in the on-state is turned off, the supply circuit 27 stops supplying the power, with the result that the other supply circuit 28 begins a constant-voltage operation, thus providing an output voltage Vo of 4.9 [V]. During this operation, a backward current from the collector of the transistor 29 to the emitter thereof will not flow, due to the reason described later. The microcomputer included in the load circuit 25 is able to sense an on/off operation of the ignition switch 23. In response to a transition of the ignition switch 23 from its on-state to its off-state, the operation mode of the microcomputer will immediately shift from its normal operation mode to the low-power-consumption operation mode. Though the supply circuit 28 is set to a reduced current output capacity compared to that of the supply circuit 27 (whereby reducing power usage), it is still sufficient to supply power to the load circuit 25.

In contrast, in response to a switchover of the ignition switch 23 from its off-state to its on-state, both of the supply circuits 27 and 28 are put into operation. Hence the output voltage Vo is stabilized to 5.0 [V], which is higher one of the target output voltage of the supply circuit 27 or that of the supply circuit 2. In consequence, the supply circuit 28 of which target output voltage is 4.9 [V] turns the transistor 43 into its off-state, because the voltage error at the inputs of the operational amplifier 49 becomes a negative value. The microcomputer in the load circuit 25 shifts its operation mode from the low-power-consumption operation mode to the normal operation mode, so that the microcomputer is able to receive the power from the supply circuit 27.

Figure 1:
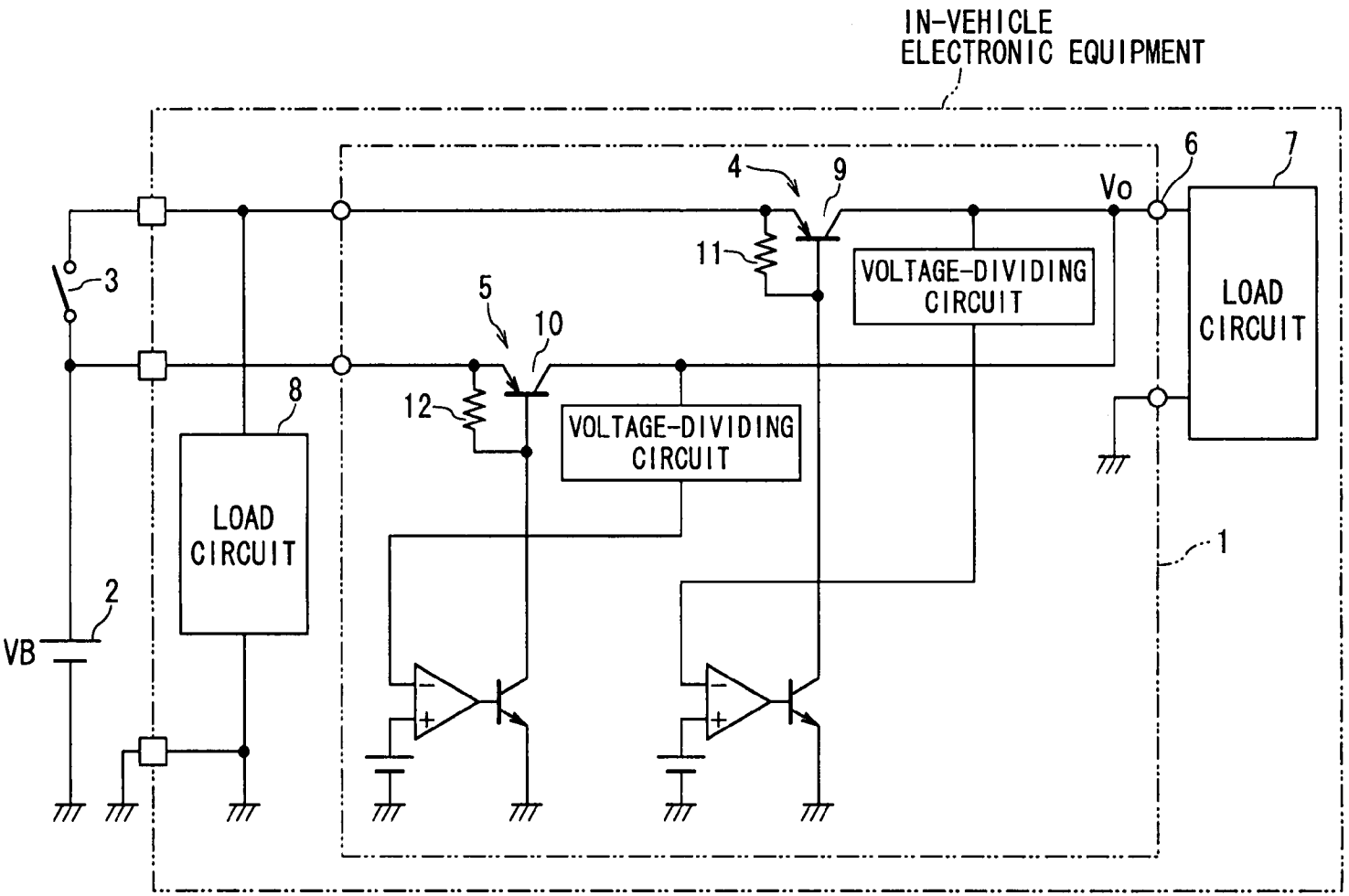
FIG. 1 PRIOR ART
FIG. 1 shows the electrical configuration of a conventional power supply circuit applied to an in-vehicle ECU.

FIGS. 3A and 3B each show the electrical configuration of essential parts of power supply circuits that were studied by the present inventors in the process for achieving the power supply circuit 24 (FIG. 2) according to the present embodiment based on the conventional power supply circuit 1 (FIG. 1). In FIGS. 3A and 3B, the identical components to those in FIG. 2 are represented by the same reference numbers. FIGS. 3A and 3B are not intended to show the formal power supply circuit, but introduced to explain only the significance of the presence of both the transistor 38 and constant-current circuit 39 in the power supply circuit 24.

The power supply circuit shown in FIG. 3A has identical circuitry to that of the conventional power supply circuit 1 except that the resistor 30 is inserted between the base and collector of the transistor 29, not the emitter and base thereof. In this configuration, if the ignition switch 23 is in its off-state, the constant voltage of 4.9 [V] outputted from the transistor 43 is applied as a backward voltage to the base/emitter junction of the transistor 29. Thus a backward current is prevented from flowing into the load circuit 26 via the transistor 29. In addition, the potential at the base of the transistor 29 is fixed to an amount that is the same as a potential at the collector thereof, thereby enhancing resistance to noise.

However the power supply circuit shown in FIG. 3A has a difficulty as follows. When the ignition switch 23 is switched to its off-state, the potential at the base of the transistor 29 becomes "VB−Vf (Vf: forward voltage)," so that a current proportional to "VB−Vf−Vo" flows through the resistor 30. All of this current passing through the resistor 30 contributes to the base current of the transistor 29 independently of what state the transistor 31 takes. Because such base current will lead to a swell in the output voltage Vo, the output voltage Vo is obliged to exceed a target output voltage (i.e., 5.0 [V]).

On the other hand, the power supply circuit shown in FIG. 3B is configured such that the transistor 38 is added to the circuitry described in FIG. 3A. This transistor 38 is able to output a constant current I1 more than a current Ia defined by the following formula (1):

$$I1 \geqq Ia = (VB - Vf - 5.0)/Ra \quad (1),$$

wherein Ra is the resistance of the resistor 30. This constant current I1 corresponds to a bypass current according to the present invention.

In cases where Vf is sufficiently smaller than "VB−5.0," the formula can be approximated to the following formula (2):

$$I1 \geqq Ia = (VB - 5.0)/Ra \quad (2).$$

In this circuitry, the current Ia passing through the resistor 30 under the on-state of the ignition switch 23 is supplied by the transistor 38, not supplied as the base current of the transistor 29. Accordingly, under conditions where a small amount of current flows into the load, the operational amplifier 35 is able to drive the transistor 31 so as to control the base current of the transistor 29, with the result that the output voltage Vo can be limited to a constant voltage. During this control operation, any excessive amount of current "I1−Ia" is grounded via the transistor 31. However, even this circuitry has a difficulty. In other words, when the output current from this power supply circuit becomes smaller than Ia, it is impossible to force the current to pass through the resistor 30, thus causing a swell in the output voltage Vo.

In order to overcome such a difficulty, the power supply circuit 24 shown in FIG. 2 according to the present embodiment has further been improved in that the constant-current circuit 39 is added to the circuit shown in FIG. 3B. The constant-current circuit 39 is in charge of absorbing, from the output current of the transistor 29, a constant amount of current I2 which is equal to the current I1 outputted by the transistor 38. In the present embodiment, the relationship of I1=I2 is kept, but this is not a definitive list. An alternative is that the current I2 to be absorbed is higher than I1; that is, the current I2 is to satisfy the following formula (3):

$$I2 \geqq I1 \quad (3).$$

In the present embodiment, the relationship of I1=I2≧Ia is fulfilled, so that the constant-current circuit 39 is able to absorb all the current Ia flowing though the resistor 30, while still limiting the output voltage Vo to 5.0 [V]. This absorption makes it possible to continue keeping the current Ia flowing through the resistor 30, even when the current flowing from the power supply circuit 24 into the load circuit 25 is reduced. Accordingly, an unwanted swell in the output voltage Vo can be prevented reliably.

As described above, the power supply circuit 24 of the present embodiment includes the two supply circuits 27 and 28 of which outputs are supplied to a common load, wherein the one supply circuit 27 is configured such that an input voltage supplied to the supply circuit 27 including the transistor 29 is stopped by turning off the ignition switch 23, wherein the resistor 30 is inserted to be connected to the base and collector of the transistor 29, instead of being connected to the emitter and base thereof. Thus, when the ignition switch 23 is in its off-state, the emitter/base Junction of the transistor 29 prevents a backward current occurring on account of the output voltage Vo. Hence a current can be prevented from circulating from the supply circuit 28 to the load circuit 26. In addition, the base potential of the transistor 29 is fixed to its collector potential, which enhances resistance to noise.

In contrast, in response to switching the ignition switch 23 to its on-state, the transistor 38 supplies the resistor 30 a current Ia, while the current-constant circuit 39 absorbs the current Ia from the output current of the transistor 29. Thus, independent of the largeness of a load current, the output voltage Vo can be adjusted to a target output voltage (in this embodiment, 5.0 [V]) under constant-voltage control.

The ECU on a vehicle operates on the power from the battery 22. Thus, whenever the vehicle is not in use and the ignition switch 23 is in its off-state, it is necessary to reduce consumed current (dark current) as much as possible through various countermeasures, such as a shift of the operation mode of the microcomputer to its low-power-consumption operation mode. Though both of the transistor 38 and the constant-current circuit 39 are added to the supply circuit 27, such an addition will not increase the dark current, because both of the transistor 38 and the constant-current circuit 39 operate to output a constant current only when the ignition switch 23 is in its on-state.

For the sake of completeness, it should be mentioned that the various embodiments explained so far are not definitive lists of possible embodiments. The expert will appreciate that it is possible to combine the various construction details or to supplement or modify them by measures known from the prior art without departing from the basic inventive principle.

Figure 4:
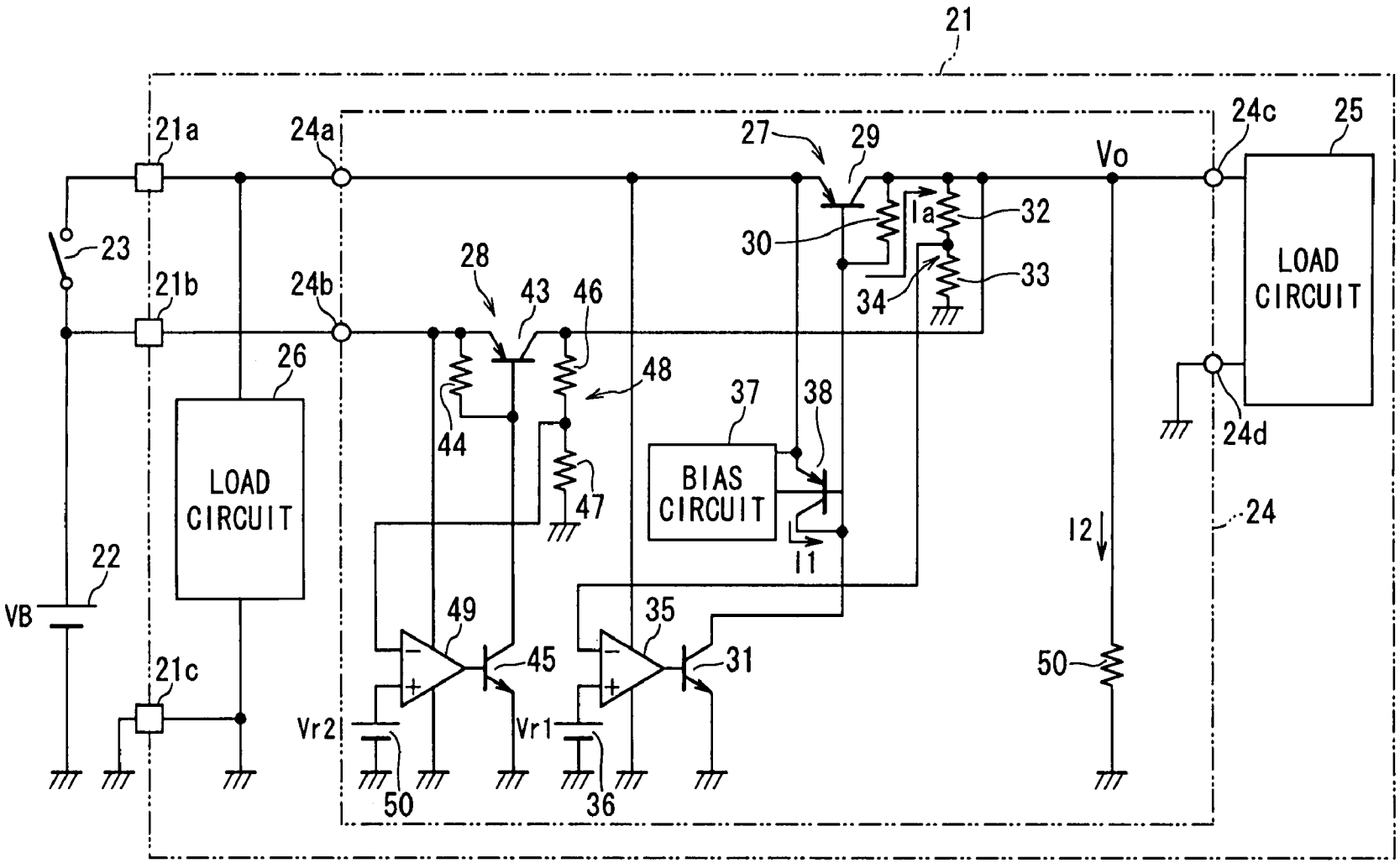
FIG. 4 shows an electrical configuration explaining a modification of the power supply circuit according to the present invention.

By way of example, the current acceptance circuit can be configured with the use of a resistor 50 (refer to FIG. 4), in place of the foregoing constant-current circuit 39 that uses the current-constant circuit. The resistance Rb of the resistor 50 can be defined based on the following formula (4):

$$Rb \leqq 5.0/I1 \quad (4).$$

In this circuitry, it is preferred that a switch circuit is connected to the resistor in series in such a manner that current is permitted to flow through the resistor only when the ignition switch 23 is in its on-state.

Further, the current bypassing circuit to be connected to the emitter and base of the transistor 29 is sufficient if the circuit has the characteristics of preventing a backward current flowing from the base of the transistor 29 to the emitter thereof and of being able to supply the current I1, so that the current bypassing circuit is not limited to a configuration that uses a constant-current circuit.

Still further, the present invention can be applied to a series regulator that employs an NPN type of transistor 29 as the foregoing main transistor.

In addition, all the NPN and PNP type transistors adopted in the power supply circuit 21 can be replaced by PNP and NPN type transistors, respectively, for the negative-voltage specification.

It is also possible to use N-MOS and P-MOS type transistors instead of the NPN and PNP type transistors.

The present invention may be embodied in several other forms without departing from the spirit thereof. The embodiments and modifications described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A power supply circuit comprising:

a transistor whose emitter and collector are connected to a power input terminal and a power output terminal, respectively, the transistor being either a PNP-type of transistor or a PMOS-type of transistor;

a voltage detection circuit configured to detect an output voltage at the power output terminal;

a voltage control circuit connected to a base of the transistor and configured to control a base current of the transistor on the basis of both of the output voltage detected by the voltage detection circuit and a given target voltage;

a resistor circuit placed to connect the base and the collector of the transistor;

a current bypass circuit placed to connect the emitter and the base of the transistor and configured to bypass the transistor so that a bypass current flows through the current bypass circuit; and a current accepting circuit connected to the power output terminal and configured to accept a given amount of current from an output current passing the power output terminal by performing either absorption or discharge of the given amount of current, wherein the amount of current to be accepted is equal to or larger than an amount of the bypass current and a product of the amount of the bypass current and a resistance value of the resistance circuit is equal to or more than a difference between a voltage at the power input terminal and the target voltage.

2. The power supply circuit according to claim 1, wherein the current acceptance circuit is configured to absorb or discharge the acceptance current only when the current bypass circuit allows the bypass current to flow therethrough.

3. The power supply circuit according to claim 1, wherein the current bypass circuit is composed of a constant-current circuit.

4. The power supply circuit according to claim 1, further comprising, other than a main supply circuit equipped with the transistor, the voltage detection circuit, the voltage control circuit, the resistor circuit, the current bypass circuit, and the current acceptance circuit, whereby the main supply circuit controls the voltage at the power output terminal, an auxiliary supply circuit configured to control the voltage at the power output terminal, independently of the voltage control performed by the main supply circuit.

5. The power supply circuit according to claim 1, wherein the current acceptance circuit is composed of a constant-current circuit.

6. The power supply circuit according to claim 5, wherein the current acceptance circuit is configured to absorb or discharge the acceptance current only when the current bypass circuit allows the bypass current to flow therethrough.

7. The power supply circuit according to claim 5, wherein the current bypass circuit is composed of a constant-current circuit.

8. The power supply circuit according to claim 5 further comprising, other than a main supply circuit equipped with the transistor, the voltage detection circuit, the voltage control circuit, the resistor circuit, the current bypass circuit, and the current acceptance circuit, whereby the main supply circuit controls the voltage at the power output terminal an auxiliary supply circuit configured to control the voltage at the power output terminal, independently of the voltage control performed by the main supply circuit.

9. The power supply circuit according to claim 1, wherein the current acceptance circuit is composed of a resistor.

10. The power supply circuit according to claim 9, wherein the current acceptance circuit is configured to absorb or discharge the acceptance current only when the current bypass circuit allows the bypass current to flow therethrough.

11. The power supply circuit according to claim 9, wherein the current bypass circuit is composed of a constant-current circuit.

12. The power supply circuit according to claim 9, further comprising, other than a main supply circuit equipped with the transistor, the voltage detection circuit, the voltage control circuit, the resistor circuit, the current bypass circuit, and the current acceptance circuit, whereby the main supply circuit controls the voltage at the power output terminal, an auxiliary supply circuit configured to control the voltage at the power output terminal, independently of the voltage control performed by the main supply circuit.

13. A power supply circuit comprising:

a transistor having a first electrode through which a current flows in, a second electrode from which the current flows out, and a third electrode controlling the current flowing from the first electrode to the second electrode, the first and second electrodes being connected to a power input terminal and a power output terminal, respectively, the transistor being either a PNP-type of transistor or a PMOS-type of transistor;

a voltage detection circuit configured to detect an output voltage at the power output terminal;

a voltage control circuit connected to the third electrode of the transistor and configured to control a current flowing to the third electrode of the transistor on the basis of both of the output voltage detected by the voltage detection circuit and a given target voltage;

a resistor circuit connected between the third electrode and the second electrode of the transistor;

a current bypass circuit connected between the first electrode and the third electrode of the transistor and configured to bypass the transistor so that a bypass current flows through the current bypass circuit; and a current accepting circuit connected to the power output terminal and configured to accept a given amount of current from an output current passing the power output terminal by performing either absorption or discharge of the given amount of current, wherein the amount of current to be accepted is equal to or larger than an amount of the bypass current and a product of the amount of the bypass current, and a resistance value of the resistance circuit is equal to or more than a difference between a voltage at the power input terminal and the target voltage.

14. The power supply circuit according to claim 13, wherein the transistor is the PNP-type of transistor, wherein the first electrode is an emitter of the PNP-type of transistor, wherein the second electrode is a collector of the PNP-type of transistor, and wherein the third electrode is a base of the PNP-type of transistor.

15. The power supply circuit according to claim 13, wherein the current acceptance circuit is configured to absorb or discharge the acceptance current only when the current bypass circuit allows the bypass current to flow therethrough.

16. The power supply circuit according to claim 13, wherein the current bypass circuit comprises a constant-current circuit.

17. The power supply circuit according to claim 13, further comprising, other than a main supply circuit equipped with the transistor, the voltage detection circuit, the voltage control circuit, the resistor circuit, the current bypass circuit, and the current acceptance circuit, whereby the main supply circuit controls the voltage at the power output terminal, an auxiliary supply circuit configured to control the voltage at the power output terminal, independently of the voltage control performed by the main supply circuit.

18. The power supply circuit according to claim 13, wherein the current acceptance circuit comprises a constant-current circuit.

19. The power supply circuit according to claim 18, wherein the current acceptance circuit is configured to absorb or discharge the acceptance current only when the current bypass circuit allows the bypass current to flow therethrough.

20. The power supply circuit according to claim 18, wherein the current bypass circuit comprises a constant-current circuit.

* * * * *